US010410765B1

(12) United States Patent
Lin

(10) Patent No.: US 10,410,765 B1
(45) Date of Patent: Sep. 10, 2019

(54) POWER CORD STRUCTURE

(71) Applicant: Chia-Hua Lin, New Taipei (TW)

(72) Inventor: Chia-Hua Lin, New Taipei (TW)

( * ) Notice: Subject to any disclaimer, the term of this patent is extended or adjusted under 35 U.S.C. 154(b) by 0 days.

(21) Appl. No.: 16/249,954

(22) Filed: Jan. 17, 2019

(51) Int. Cl.

| | |
|---|---|
| ***H01B 7/36*** | (2006.01) |
| ***H01B 7/00*** | (2006.01) |
| *H01R 103/00* | (2006.01) |
| *H01R 24/22* | (2011.01) |
| *H01R 24/30* | (2011.01) |

(52) U.S. Cl.
CPC ..... *H01B 7/363* (2013.01); *H01B 7/0009* (2013.01); *H01B 7/361* (2013.01); *H01R 24/22* (2013.01); *H01R 24/30* (2013.01); *H01R 2103/00* (2013.01)

(58) Field of Classification Search
CPC ..... H01B 7/363; H01B 7/361; H01B 7/0009
USPC ..... 174/112
See application file for complete search history.

(56) References Cited

U.S. PATENT DOCUMENTS

| | | | | |
|---|---|---|---|---|
| 2,610,607 A * | 9/1952 | Isenberg | H01B 13/34 118/412 |
| 3,054,710 A * | 9/1962 | Nixon | H01B 7/361 156/52 |
| 2005/0045366 A1* | 3/2005 | Wolff | H01B 7/0009 174/113 R |
| 2005/0263315 A1* | 12/2005 | Marszalek | E05B 45/005 174/108 |
| 2012/0103646 A1* | 5/2012 | Fox | H01B 9/028 174/34 |

* cited by examiner

*Primary Examiner* — Sherman Ng
(74) *Attorney, Agent, or Firm* — WPAT, PC

(57) ABSTRACT

A power cord structure is disclosed, comprising a conductive cord body consisting of plural conductive cords which are mutually entangled at a twist distance satisfying security requirements, and an opaque insulation protective outer layer, wherein the insulation protective outer layer includes an insulation cladding layer and a spiral color correspondence layer, the insulation cladding layer is wrapped around the outside of the conductive cord body; also, the spiral color correspondence layer spirally displays on the outer surface of the insulation cladding layer with at least three color segments, and the interval widths of such at least three color segments are in a proportional ratio to the twist distance satisfying security requirements of the plural conductive cords.

7 Claims, 6 Drawing Sheets

POWER CORD STRUCTURE

BACKGROUND OF THE INVENTION

1. Field of the Invention

The present invention generally relates to a power cord structure; in particular, it relates to a power cord structure allowing to determine whether the twist distance of the internal conductive cords satisfies security requirements in accordance with the intervals of at least three color segments on the surface.

2. Description of Related Art

The power supply system is an extremely important infrastructure in modern societies, and alternative current (AC) power cords can be utilized as the main medium for transporting electricity in the power supply system; in general, with respect to common municipal power systems, every country in the world has stipulated various relevant regulations, laws and security norms in order to maintain the safety of electrical equipments and electric power applications.

For a general AC power cord, a layer of insulation cladding will be wrapped around the outside of the internal metal wire so as to avoid the exposure of the internal metal wire used for power transmissions thus effectively preventing dangerous accidents; also, the main function of such insulation claddings of the AC power cord is to provide electrical insulation features, and most of them are made of PVC plastic materials; in addition, depending on the categories, specifications and applications of such AC power cords, the insulation cladding on certain types of AC power cords may be required to have the abilities to resist physical or mechanical damages or corrosion problems.

Considering an AC power cord 1 for general household usage, the AC power cord 1 may have a plug 2 at its one end, and the other end of the AC power cord 1 is connected to an electronic device 3. Herein the AC power cord 1 includes three metal conductive cords 12, 13, 14 covered with an insulation sheath 11 on the outside, and the outer side of the insulation sheath 11 is further wrapped up with a protective outer layer 15. That is, such a protective outer layer 15 can wrap together the insulation sheaths 11 of the aforementioned three metal conductive cords 12, 13, 14 so as to protect such three metal conductive cords 12, 13, 14 included therein thus enabling increased resistance to physical or mechanical damages or corrosion issues.

However, the metal conductive cords 12, 13, 14 are intertwined with the twist distance according to security requirements, and different wire diameters may correspond to different twist distances that meet relevant safety requirements or regulations. An exemplary specification list is shown as below:

| | | Wire Diameter ($mm^2$) | | | | | |
|---|---|---|---|---|---|---|---|
| | | 0.824 | 1.31 | 2.08 | 3.31 | 5.26 | 8.37 |
| Twist Distance Satisfying Security Requirements (mm) | Two-Twisted Cords | 35~51 | 38~57 | 64 | 76 | 89 | 114 |
| | Three-Twisted Cords | 44~57 | 51~64 | 83 | 89 | 108 | 127 |

But, in currently available commercial power cords, only the transparent insulation sheath can allow the user to directly observe whether the twist distance of the internal conductive cords satisfies relevant safety regulations or not, which means. If the insulation sheath is opaque, it is impossible to appreciate whether the twist distance of the internal conductive cords complies with the regulations. Therefore, this may result in a sort of loophole that certain manufacturers could possibly not follow the above-mentioned specifications on cord twisting; thus, to check the inside of the AC power cord 1, it needs to cut the AC power cord and peel off its insulation sheath 11 so as to see the internal strand structure, which is impossible to perform for general users.

Therefore, it would be an optimal solution suppose it is possible that, in case of an opaque insulation sheath, different colors can be spirally displayed on the insulation sheath, and the interval widths of at least three color segments are in a proportional ratio with respect to the twist distance satisfying relevant security regulations of the conductive cords in the conductive cord body, such that it needs only to observe the distribution of such at least three colors shown on the surface in order to allow a user to clearly understand whether the twist distance of the conductive cords in the conductive cord body is indeed manufactured according to the specifications complying with relevant security regulations.

SUMMARY OF THE INVENTION

A power cord structure, comprising a conductive cord body consisting of plural conductive cords which are mutually entangled at a twist distance satisfying security requirements; also, an insulation protective outer layer, made of opaque materials and including an insulation cladding layer and a spiral color correspondence layer, wherein the insulation cladding layer is wrapped around the outside of the conductive cord body, the spiral color correspondence layer spirally displays on the outer surface of the insulation cladding layer with at least three color segments, and the interval widths of such at least three color segments are in a proportional ratio with respect to the twist distance of the plural conductive cords in the conductive cord body.

In a preferred embodiment, the power cord structure is an alternative current (AC) power cord.

In a preferred embodiment, the conductive cord body is formed by means of two conductive cords mutually entangled at a twist distance satisfying security requirements.

In a preferred embodiment, the conductive cord body is formed by means of three conductive cords mutually entangled at a twist distance satisfying security requirements.

In a preferred embodiment, the spiral color correspondence layer includes a first color segment, a second color segment and a third color segment, and such first color segment, second color segment and third color segment have respectively a different color.

In a preferred embodiment, the spirally displaying on the outer surface of the insulation cladding layer can be achieved by means of the repeatedly sequential arrangement with the first color segment, the second color segment and the third color segment.

In a preferred embodiment, the spirally displaying on the outer surface of the insulation cladding layer can be achieved by means of the repeatedly sequential arrangement with the first color segment, the second color segment, the first color segment and the third color segment.

DETAILED DESCRIPTION OF THE PREFERRED EMBODIMENTS

Other technical contents, aspects and effects in relation to the present invention can be clearly appreciated through the detailed descriptions concerning the preferred embodiments of the present invention in conjunction with the appended drawings.

Figure 1:
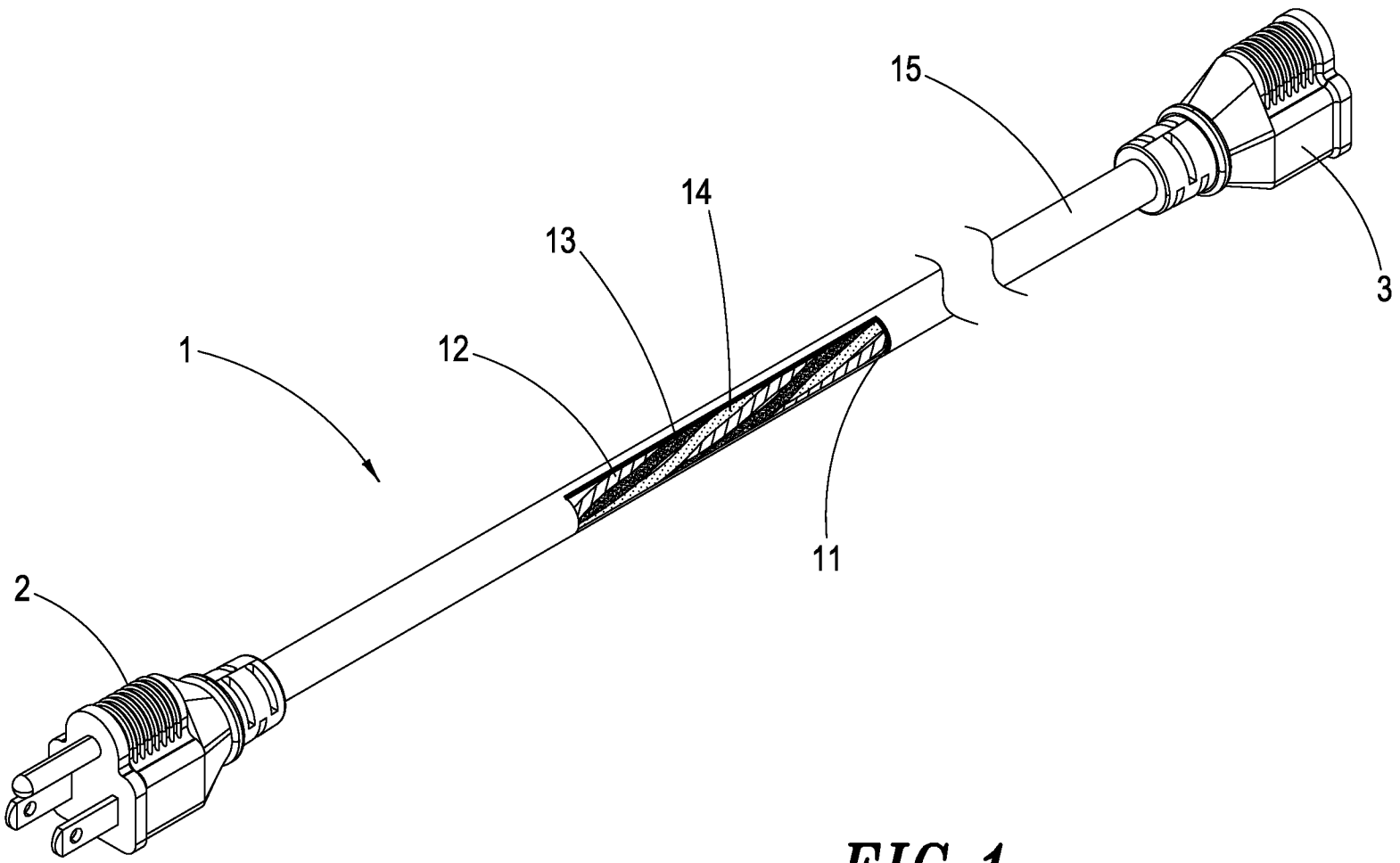
FIG. 1 shows a view of the internal twisted cords of a conventional AC power cord.
Figure 2A:
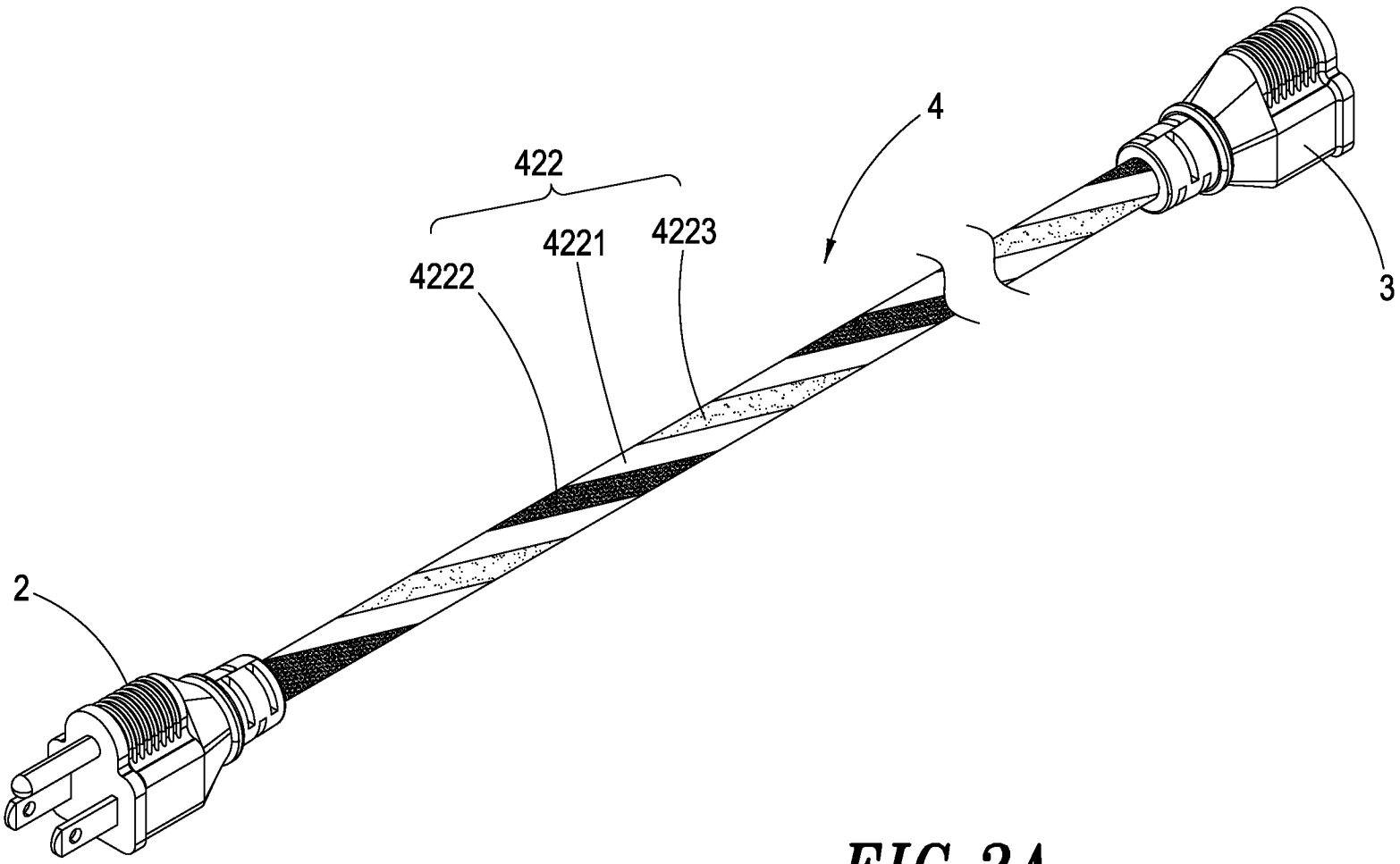
FIG. 2A shows an exterior structural view for a first embodiment of the power cord structure according to the present invention.
Figure 2B:
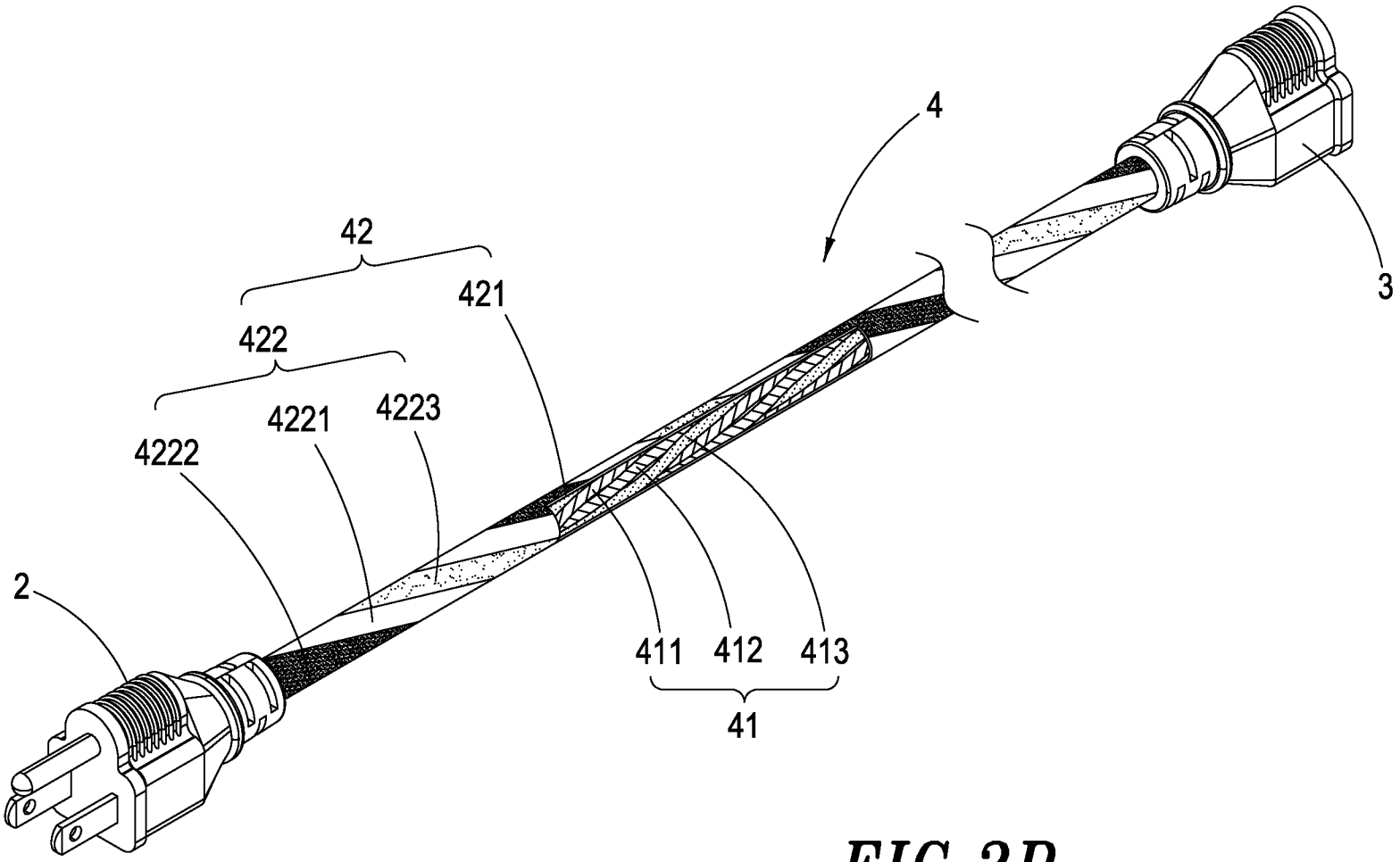
FIG. 2B shows an interior partial structural view for the first embodiment of the power cord structure according to the present invention.

Refer first to FIGS. 2A-2B, wherein an exterior structural view and an interior partial structural view for a first embodiment of the power cord structure according to the present invention are respectively shown. Herein the power cord structure 4 is an alternative current (AC) power cord and includes a conductive cord body 41 and an insulation protective outer layer 42, and the conductive cord body 41 is manufactured with plural conductive cords 411, 412, 413 entangled at a twist distance satisfying security requirements (three conductive cords 411, 412, 413 are exemplarily used and twisted in the present embodiment).

Also, the insulation protective outer layer 42 is made of opaque materials and includes an insulation cladding layer 421 and a spiral color correspondence layer 422, in which the insulation cladding layer 421 is wrapped around the outside of the conductive cord body 41, and the spiral color correspondence layer 422 has a first color segment 4221, a second color segment 4222 and a third color segment 4223, with each of the first color segment 4221, second color segment 4222 and third color segment 4223 having a difference color.

It can be seen that the first color segment 4221, second color segment 4222 and third color segment 4223 display on the outer surface of the insulation cladding layer 421 with their color segments, and the interval widths between such three color segments are in a proportional ratio to the twist distance satisfying security requirements of the plural conductive cords 411, 412, 413 in the conductive cord body 41.

Figure 3:
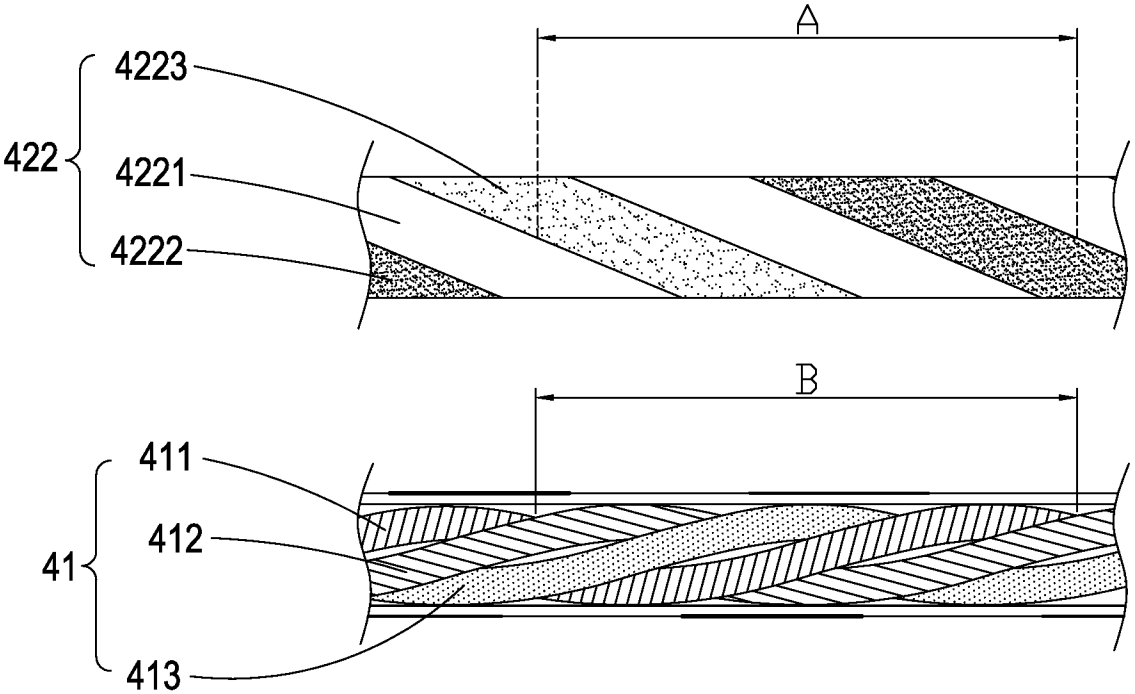
FIG. 3 shows a comparison view of the interval widths of such colors and the twist distance satisfying relevant security regulation for the first embodiment of the power cord structure according to the present invention.

As shown in FIG. 3, the interval width A displayed by the first color segment 4221, second color segment 4222 and third color segment 4223 is in a proportional ratio to the twist distance B satisfying security requirements of the plural conductive cords 411, 412, 413, such that, when a user sees the first color segment 4221, second color segment 4222 and third color segment 4223 on the surface, it is possible to reversely infer and appreciate whether the twist distance B meets security requirements base don the interval distance A, and the verification personnel also does not need to peel off the insulation protective outer layer 42 in order to confirm whether the internal twist distance meets security requirements.

Figure 4:
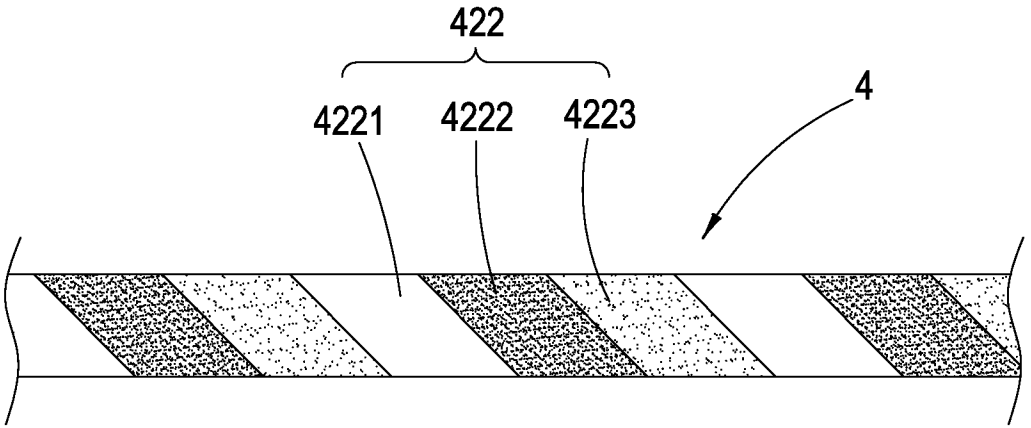
FIG. 4 shows another exterior structural view for the first embodiment of the power cord structure according to the present invention.

Moreover, as shown in FIG. 2A, the sequence for such first color segment 4221, second color segment 4222 and third color segment 4223 may be arranged as the first color segment 4221, second color segment 4222, first color segment 4221 and then third color segment 4223 and so forth; or alternatively, as shown in FIG. 4, the sequence may be arranged as the first color segment 4221, second color segment 4222 and then third color segment 4223, thus repeatedly displayed.

Figure 5:
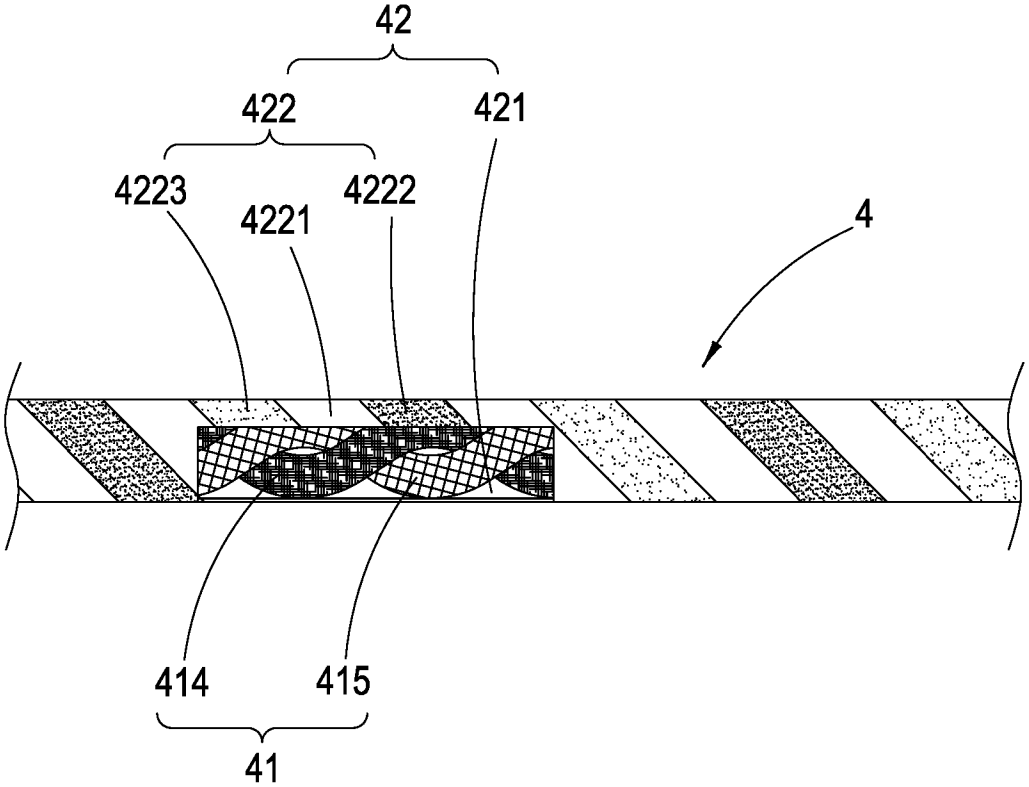
FIG. 5 shows an interior partial structural view for a second embodiment of the power cord structure according to the present invention.

Furthermore, in addition that the conductive cord body 41 having three conductive cords 411, 412, 413 is manufactured in a twisted form at a twist distance satisfying security requirements, it is possible to alternatively use simply two conductive cords 414, 415 to fabricate a twisted cord at a twist distance satisfying security requirements, in which at least three color segments are provided and able to display whether the twist distance of the two-conductive-cord body 41 satisfies security requirements, as shown in FIG. 5; while other features thereof are identical to those previously illustrated in FIGS. 1-4, they are herein omitted for brevity.

In comparison with other conventional technologies, the power cord structure according to the present invention provides the following advantages:

1. The present invention configures the spiral color correspondence layer on the insulation cladding layer so the user needs only to look at the spiral color correspondence layer shown on the insulation cladding layer to know whether the twist distance of the conductive cord body in the power cord structure satisfies security requirements.
2. The present invention configures and displays the spiral color correspondence layer of different colors on the insulation cladding layer, and the interval widths of the at least three color segments are in a proportional ratio to the twist distance satisfying security requirements of the conductive cords in the conductive cord body, so it needs only to observe the color distribution shown on the surface to clearly understand the conductive cords in the conductive cord body are indeed manufactured in accordance with specifications featuring a twist distance satisfying security requirements.
3. The present invention allows to demonstrate the relative ratio value on the product packages such that the verification personnel can reversely infer whether the twist distance satisfies security requirements based on the interval widths, and also know the internal twist distance satisfying security requirements without having to peel off the insulation protective outer layer.

It should be noticed that, although the present invention has been disclosed through the detailed descriptions of the aforementioned embodiments, such illustrations are by no means used to restrict the scope of the present invention; that is, skilled ones in relevant fields of the present invention can certainly devise any applicable alternations and modifications after having comprehended the aforementioned technical characteristics and embodiments of the present invention without departing from the spirit and scope thereof. Hence, the scope of the present invention to be protected under patent laws should be decordated in accordance with the claims set forth hereunder in the present specification.

What is claimed is:

1. A power cord structure, comprising:

a conductive cord body, formed by means of plural conductive cords mutually entangled at a twist distance satisfying security requirements; and an insulation protective outer layer, made of opaque materials, including an insulation cladding layer and a spiral color correspondence layer, in which the insulation cladding layer wraps around the outside of the conductive body, the spiral color correspondence layer spirally displays on the outer surface of the insulation cladding layer with at least three color segments, and the interval widths between such three color segments are in a proportional ratio to the twist distance of the plural conductive cords in the conductive cord body.

2. The power cord structure according to claim 1, wherein the power cord structure is an alternative current (AC) power cord.

3. The power cord structure according to claim 1, wherein the conductive cord body is formed by means of two conductive cords mutually entangled at a twist distance satisfying security requirements.

4. The power cord structure according to claim 1, wherein the conductive cord body is formed by means of three conductive cords mutually entangled at a twist distance satisfying security requirements.

5. The power cord structure according to claim 1, wherein the spiral color correspondence layer includes a first color segment, a second color segment and a third color segment, and such first color segment, second color segment and third color segment have respectively a different color.

6. The power cord structure according to claim 5, wherein the spirally displaying on the outer surface of the insulation cladding layer can be achieved by means of the repeatedly sequential arrangement with the first color segment, the second color segment and the third color segment.

7. The power cord structure according to claim 5, wherein the spirally displaying on the outer surface of the insulation cladding layer can be achieved by means of the repeatedly sequential arrangement with the first color segment, the second color segment, the first color segment and the third color segment.

* * * * *